US009583838B2

(12) United States Patent
Zhu et al.

(10) Patent No.: US 9,583,838 B2
(45) Date of Patent: Feb. 28, 2017

(54) ELECTRONIC DEVICE WITH INDIRECTLY FED SLOT ANTENNAS

(71) Applicant: Apple Inc., Cupertino, CA (US)

(72) Inventors: Jiang Zhu, Sunnyvale, CA (US); Harish Rajagopalan, Cupertino, CA (US); Rodney A. Gomez Angulo, Sunnyvale, CA (US); Qingxiang Li, Mountain View, CA (US); Robert W. Schlub, Cupertino, CA (US); John Raff, Menlo Park, CA (US)

(73) Assignee: Apple Inc., Cupertino, CA (US)

( * ) Notice: Subject to any disclaimer, the term of this patent is extended or adjusted under 35 U.S.C. 154(b) by 99 days.

(21) Appl. No.: 14/220,467

(22) Filed: Mar. 20, 2014

(65) Prior Publication Data

US 2015/0270618 A1 Sep. 24, 2015

(51) Int. Cl.

| | |
|---|---|
| ***H01Q 13/10*** | (2006.01) |
| ***H01Q 1/24*** | (2006.01) |
| ***H01Q 1/22*** | (2006.01) |
| ***H01Q 5/40*** | (2015.01) |

(52) U.S. Cl.

CPC ..... *H01Q 13/10* (2013.01); *H01Q 1/2258* (2013.01); *H01Q 1/2266* (2013.01); *H01Q 1/243* (2013.01); *H01Q 5/40* (2015.01); *H01Q 13/103* (2013.01)

(58) Field of Classification Search

CPC ..... H01Q 1/24; H01Q 1/241; H01Q 1/242; H01Q 1/243; H01Q 5/30; H01Q 5/307; H01Q 5/314; H01Q 5/328

USPC ..... 343/700 MS, 702, 725, 729, 767, 789; 455/41.1, 41.2

See application file for complete search history.

(56) References Cited

U.S. PATENT DOCUMENTS

| | | | |
|---|---|---|---|
| 4,016,490 | A | 4/1977 | Weckenmann et al. |
| 4,614,937 | A | 9/1986 | Poujois |
| 5,337,353 | A | 8/1994 | Bole et al. |

(Continued)

FOREIGN PATENT DOCUMENTS

| | | |
|---|---|---|
| CN | 1343380 | 4/2002 |
| CN | 1543010 | 11/2004 |

(Continued)

OTHER PUBLICATIONS

Liu et al.; MEMS-Switched, Frequency-Tunable Hybrid Slot/PIFA Antenna; IEEE Antennas and Wireless Propagation Letters, vol. 8, 2009; p. 311-314.*

(Continued)

*Primary Examiner* — Dameon E Levi
*Assistant Examiner* — Ab Salam Alkassim, Jr.
(74) *Attorney, Agent, or Firm* — Treyz Law Group, P.C.; G. Victor Treyz; Michael H. Lyons

(57) ABSTRACT

An electronic device may be provided with antennas. Antennas for the electronic device may be formed from slot antenna structures. A slot antenna structure may be formed from portions of a metal housing for an electronic device. The slots of the slot antenna structures may be indirectly fed to form first and second indirectly fed slot antennas. The first and second indirectly fed slot antennas may be formed from slots in a rear surface of an electronic device and a sidewall of the electronic device. The slots may have open ends along an edge of the sidewall and may have closed ends that face each other. A hybrid antenna may also be formed in the electronic device.

18 Claims, 12 Drawing Sheets

(56) References Cited

U.S. PATENT DOCUMENTS 5,410,497 A 4/1995 Viletto
5,463,406 A 10/1995 Vannatta et al.
5,650,597 A 7/1997 Redmayne
5,826,458 A 10/1998 Little
5,854,972 A 12/1998 Pennock et al.
5,864,316 A 1/1999 Bradley et al.
5,905,467 A 5/1999 Narayanaswamy et al.
5,956,626 A 9/1999 Kashke et al.
6,181,281 B1 * 1/2001 Desclos ..... H01Q 1/38 343/700 MS
6,301,489 B1 10/2001 Winstead et al.
6,329,958 B1 12/2001 McLean et al.
6,380,899 B1 4/2002 Madsen et al.
6,408,193 B1 6/2002 Katagishi et al.
6,445,906 B1 * 9/2002 Nguyen ..... H01Q 13/085 343/701
6,456,856 B1 9/2002 Werling et al.
6,480,162 B2 * 11/2002 Sabet ..... H01Q 1/36 343/767
6,529,088 B2 3/2003 Lafleur et al.
6,590,539 B2 7/2003 Shinichi
6,611,227 B1 8/2003 Nebiyeloul-Kifle et al.
6,657,595 B1 12/2003 Phillips et al.
6,678,532 B1 1/2004 Mizoguchi
6,741,214 B1 5/2004 Kadambi et al.
6,759,989 B2 * 7/2004 Tarvas ..... H01Q 1/243 343/700 MS
6,788,266 B2 * 9/2004 St. Hillaire ..... H01Q 1/38 343/770
6,879,293 B2 4/2005 Sato
6,975,276 B2 * 12/2005 Brown ..... H01Q 3/46 343/767
6,978,121 B1 12/2005 Lane et al.
6,985,108 B2 1/2006 Mikkola
6,985,113 B2 1/2006 Nishimura et al.
7,016,686 B2 3/2006 Spaling et al.
7,039,435 B2 5/2006 McDowell et al.
7,050,010 B2 5/2006 Wang et al.
7,109,945 B2 9/2006 Mori
7,113,087 B1 9/2006 Casebolt et al.
7,146,139 B2 12/2006 Nevermann
7,221,092 B2 5/2007 Anzai et al.
7,356,361 B1 4/2008 Hawkins et al.
7,388,550 B2 6/2008 McLean
7,482,991 B2 * 1/2009 Boyle ..... H01Q 1/243 343/767
7,499,722 B2 3/2009 McDowell et al.
7,502,221 B2 3/2009 Fuller et al.
7,522,846 B1 4/2009 Lewis et al.
7,538,760 B2 5/2009 Hotelling et al.
7,551,142 B1 6/2009 Zhang et al.
7,557,760 B2 7/2009 Chang et al.
7,595,788 B2 9/2009 Son
7,633,076 B2 12/2009 Huppi et al.
7,663,612 B2 2/2010 Bladt
7,705,787 B2 4/2010 Ponce De Leon
7,826,875 B2 11/2010 Karaoguz et al.
7,834,813 B2 11/2010 Caimi et al.
7,848,771 B2 * 12/2010 Boyle ..... H01Q 1/242 343/702
7,864,123 B2 1/2011 Hill et al.
7,876,274 B2 1/2011 Hobson et al.
7,999,748 B2 8/2011 Lightenberg et al.
8,059,039 B2 11/2011 Ayala Vazquez et al.
8,059,040 B2 11/2011 Ayala Vazquez et al.
8,115,753 B2 2/2012 Newton
8,159,399 B2 4/2012 Dorsey et al.
8,228,198 B2 7/2012 McAllister
8,238,971 B2 8/2012 Terlizzi
8,255,009 B2 8/2012 Sorensen et al.
8,270,914 B2 9/2012 Pascolini et al.
8,319,692 B2 11/2012 Chiang et al.
8,325,094 B2 12/2012 Ayala Vazquez et al.
8,326,221 B2 12/2012 Dorsey et al.
8,347,014 B2 1/2013 Schubert et al.
8,368,602 B2 2/2013 Hill
8,417,296 B2 4/2013 Caballero et al.
8,432,322 B2 4/2013 Amm et al.
8,436,816 B2 5/2013 Leung et al.
8,466,839 B2 6/2013 Schlub et al.
8,497,806 B2 7/2013 Lai
8,517,383 B2 8/2013 Wallace et al.
8,525,734 B2 9/2013 Krogerus
8,531,337 B2 9/2013 Soler Castany et al.
8,577,289 B2 11/2013 Schlub et al.
8,610,629 B2 12/2013 Pascolini et al.
8,638,266 B2 * 1/2014 Liu ..... H01Q 9/0421 343/767
8,638,549 B2 1/2014 Garelli et al.
8,648,752 B2 2/2014 Ramachandran et al.
8,749,523 B2 6/2014 Pance et al.
8,781,420 B2 7/2014 Schlub et al.
8,798,554 B2 8/2014 Darnell et al.
8,836,587 B2 9/2014 Darnell et al.
8,872,706 B2 10/2014 Caballero et al.
8,896,488 B2 11/2014 Ayala Vazquez et al.
8,947,302 B2 2/2015 Caballero et al.
8,947,305 B2 2/2015 Amm et al.
8,952,860 B2 2/2015 Li et al.
8,963,782 B2 2/2015 Ayala Vazquez et al.
9,024,823 B2 5/2015 Bevelacqua
2002/0015024 A1 2/2002 Westerman et al.
2002/0027474 A1 3/2002 Bonds
2002/0060645 A1 5/2002 Shinichi
2002/0094789 A1 7/2002 Harano
2002/0123309 A1 9/2002 Collier et al.
2003/0062907 A1 4/2003 Nevermann
2003/0186728 A1 10/2003 Manjo
2003/0193438 A1 10/2003 Yoon
2003/0197597 A1 10/2003 Bahl et al.
2003/0210203 A1 11/2003 Phillips et al.
2003/0218993 A1 11/2003 Moon et al.
2004/0051670 A1 3/2004 Sato
2004/0080457 A1 4/2004 Guo et al.
2004/0104853 A1 6/2004 Chen
2004/0176083 A1 9/2004 Shiao et al.
2004/0189542 A1 9/2004 Mori
2004/0222926 A1 11/2004 Kontogeorgakis et al.
2004/0239575 A1 12/2004 Shoji
2005/0146475 A1 * 7/2005 Bettner ..... G06F 1/1616 343/767
2005/0168384 A1 8/2005 Wang et al.
2005/0245204 A1 11/2005 Vance
2005/0264466 A1 12/2005 Hibino et al.
2006/0001576 A1 * 1/2006 Contopanagos ..... H01Q 1/241 343/702
2006/0152497 A1 7/2006 Rekimoto
2006/0161871 A1 7/2006 Hotelling et al.
2006/0232468 A1 10/2006 Parker et al.
2006/0244663 A1 11/2006 Fleck et al.
2006/0248363 A1 11/2006 Chen et al.
2006/0274493 A1 12/2006 Richardson et al.
2006/0278444 A1 12/2006 Binstead
2007/0120740 A1 5/2007 Iellici et al.
2007/0126711 A1 6/2007 Oshita
2007/0188375 A1 8/2007 Richards et al.
2007/0239921 A1 10/2007 Toorains et al.
2008/0165063 A1 7/2008 Schlub et al.
2008/0246735 A1 10/2008 Reynolds et al.
2008/0248837 A1 10/2008 Kunkel
2008/0297487 A1 12/2008 Hotelling et al.
2008/0309836 A1 12/2008 Sakama et al.
2008/0316120 A1 12/2008 Hirota et al.
2009/0000023 A1 1/2009 Wegelin et al.
2009/0096683 A1 4/2009 Rosenblatt et al.
2009/0128435 A1 5/2009 Jeng
2009/0153407 A1 * 6/2009 Zhang ..... H01Q 1/243 343/702
2009/0153410 A1 * 6/2009 Chiang ..... H01Q 13/08 343/702
2009/0174611 A1 7/2009 Schlub et al.
2009/0256757 A1 10/2009 Chiang
2009/0256758 A1 10/2009 Schlub et al.

(56) References Cited

U.S. PATENT DOCUMENTS

| | | | | |
|---|---|---|---|---|
| 2009/0295648 | A1 | 12/2009 | Dorsey et al. | |
| 2010/0062728 | A1 | 3/2010 | Black et al. | |
| 2010/0079351 | A1 | 4/2010 | Huang et al. | |
| 2010/0081374 | A1 | 4/2010 | Moosavi | |
| 2010/0109971 | A2 | 5/2010 | Gummalia et al. | |
| 2010/0167672 | A1 | 7/2010 | Ahn et al. | |
| 2010/0182203 | A1 | 7/2010 | See | |
| 2010/0238072 | A1* | 9/2010 | Ayatollahi | H01Q 1/243 343/700 MS |
| 2010/0253651 | A1 | 10/2010 | Day | |
| 2011/0012793 | A1 | 1/2011 | Amm et al. | |
| 2011/0012794 | A1 | 1/2011 | Schlub et al. | |
| 2011/0045789 | A1 | 2/2011 | Sinton et al. | |
| 2011/0050509 | A1 | 3/2011 | Ayala Vazquez et al. | |
| 2011/0212746 | A1 | 9/2011 | Sarkar et al. | |
| 2011/0241949 | A1 | 10/2011 | Nickel et al. | |
| 2011/0260924 | A1 | 10/2011 | Roy | |
| 2011/0260939 | A1 | 10/2011 | Korva et al. | |
| 2011/0300907 | A1* | 12/2011 | Hill | H01Q 9/285 455/566 |
| 2012/0009983 | A1 | 1/2012 | Mow et al. | |
| 2012/0068893 | A1 | 3/2012 | Guterman et al. | |
| 2012/0092298 | A1 | 4/2012 | Koottungal | |
| 2012/0112969 | A1 | 5/2012 | Caballero et al. | |
| 2012/0112970 | A1 | 5/2012 | Caballero et al. | |
| 2012/0176279 | A1 | 7/2012 | Merz et al. | |
| 2012/0214412 | A1 | 8/2012 | Schlub et al. | |
| 2012/0223865 | A1 | 9/2012 | Li et al. | |
| 2012/0223866 | A1 | 9/2012 | Ayala Vazquez et al. | |
| 2012/0229360 | A1* | 9/2012 | Jagielski | H01Q 9/30 343/860 |
| 2012/0299785 | A1 | 11/2012 | Bevelacqua | |
| 2013/0050038 | A1 | 2/2013 | Eom et al. | |
| 2013/0082884 | A1* | 4/2013 | Gummalla | G06F 1/1656 343/702 |
| 2013/0106660 | A1 | 5/2013 | Kang | |
| 2013/0115884 | A1* | 5/2013 | Zhang | H01Q 1/243 455/41.2 |
| 2013/0154900 | A1* | 6/2013 | Tsai | H01Q 1/243 343/906 |
| 2013/0169490 | A1 | 7/2013 | Pascolini et al. | |
| 2013/0201067 | A1 | 8/2013 | Hu et al. | |
| 2013/0203364 | A1 | 8/2013 | Darnell et al. | |
| 2013/0234910 | A1 | 9/2013 | Oh et al. | |
| 2013/0257659 | A1 | 10/2013 | Darnell et al. | |
| 2013/0285857 | A1 | 10/2013 | Schultz | |
| 2013/0293425 | A1* | 11/2013 | Zhu | H01Q 1/243 343/702 |
| 2013/0321216 | A1 | 12/2013 | Jervis et al. | |
| 2013/0328730 | A1 | 12/2013 | Guterman et al. | |
| 2013/0333496 | A1 | 12/2013 | Boutouil et al. | |
| 2013/0342411 | A1 | 12/2013 | Jung | |
| 2014/0009352 | A1* | 1/2014 | Sung | H01Q 1/243 343/770 |
| 2014/0086441 | A1 | 3/2014 | Zhu et al. | |
| 2014/0184450 | A1* | 7/2014 | Koo | H01Q 5/335 343/702 |
| 2014/0266941 | A1 | 9/2014 | Ayala Vazquez et al. | |
| 2014/0375509 | A1 | 12/2014 | Vance et al. | |
| 2015/0180123 | A1* | 6/2015 | Tatomirescu | H01Q 5/371 343/750 |
| 2015/0236426 | A1 | 8/2015 | Zhu et al. | |
| 2015/0255851 | A1 | 9/2015 | Guterman et al. | |
| 2015/0257158 | A1 | 9/2015 | Jadhav et al. | |
| 2015/0270618 | A1 | 9/2015 | Zhu et al. | |
| 2015/0270619 | A1 | 9/2015 | Zhu et al. | |
| 2015/0311594 | A1 | 10/2015 | Zhu et al. | |

FOREIGN PATENT DOCUMENTS

| | | |
|---|---|---|
| CN | 101330162 | 12/2008 |
| DE | 102005035935 | 2/2007 |
| EP | 0086135 | 8/1983 |
| EP | 0 564 164 | 10/1993 |
| EP | 1298809 | 4/2003 |
| EP | 1324425 | 7/2003 |
| EP | 1361623 | 11/2003 |
| EP | 1 469 550 | 10/2004 |
| EP | 1 524 774 | 4/2005 |
| EP | 1564896 | 8/2005 |
| EP | 1593988 | 11/2005 |
| GB | 2 380 359 | 4/2003 |
| JP | 05-128828 | 5/1993 |
| JP | 2003179670 | 6/2003 |
| JP | 2003209483 | 7/2003 |
| JP | 2003330618 | 11/2003 |
| JP | 2004005516 | 1/2004 |
| JP | 200667061 | 3/2006 |
| JP | 2007-170995 | 7/2007 |
| JP | 2008046070 | 2/2008 |
| JP | 2009032570 | 2/2009 |
| WO | 0131733 | 5/2001 |
| WO | 02/05443 | 1/2002 |
| WO | 2004010528 | 1/2004 |
| WO | 2004112187 | 12/2004 |
| WO | 2005112280 | 11/2005 |
| WO | 2006060232 | 6/2006 |
| WO | 2007124333 | 1/2007 |
| WO | 2007116790 | 10/2007 |
| WO | 2008/078142 | 7/2008 |
| WO | 2009022387 | 2/2009 |
| WO | 2009149023 | 12/2009 |
| WO | 2011022067 | 2/2011 |
| WO | 2013123109 A1 | 8/2013 |
| WO | 2013165419 | 11/2013 |

OTHER PUBLICATIONS

Liu et al.; MEMS-Switched Frequency-Tunable Hybrid Slot/PIFA Antenna; IEEE Antennas and Wireless Propagation Letters, vol. 82009; p. 311-314.*

Liu et al.; MEMS-Switched Frequency-Tuanble Hybrid Slot/PIFA Antenna; IEEE Antennas and Wireless Propagation Letters, vol. 82009; p. 311-314.*

Yarga et al., U.S. Appl. No. 13/790,549, filed Mar. 8, 2013.

Jiang et al., U.S. Appl. No. 13/864,968, filed Apr. 17, 2013.

Schlub et al., U.S. Appl. No. 13/420,278, filed Mar. 14, 2012.

Zhu et al., U.S. Appl. No. 13/402,831, filed Feb. 22, 2012.

Ayala Vazquez et al., U.S. Appl. No. 13/895,194, filed May 15, 2013.

Bevelacqua et al., U.S. Appl. No. 13/860,396, filed Apr. 10, 2013.

Vazquez et al., U.S. Appl. No. 13/889,987, filed May 8, 2013.

Hu et al., U.S. Appl. No. 13/890,013, filed May 8, 2013.

Bevelacqua et al., U.S. Appl. No. 13/851,471, filed Mar. 27, 2013.

Jin et al., U.S. Appl. No. 13/846,471, filed Mar. 18, 2013.

Ouyang et al., U.S. Appl. No. 13/846,459, filed Mar. 18, 2013.

Zhou et al., U.S. Appl. No. 13/846,481, filed Mar. 18, 2013.

Schlub et al., U.S. Appl. No. 13/865,578, filed Apr. 18, 2013.

Caballero et al., U.S. Appl. No. 13/886,157, filed May 2, 2013.

Yarga et al., U.S. Appl. No. 13/855,568, filed Apr. 2, 2013

Zhu et al., U.S. Appl. No. 14/180,866, filed Feb. 14, 2014.

Pance et al., U.S. Appl. No. 61/235,905, filed Aug. 21, 2009.

Myllmaki et al., "Capacitive recognition of the user's hand grip position in mobile handsets", Progress in Electromagnetics Research B, vol. 22, 2010, pp. 203-220.

"CapTouch Programmable Controller for Single-Electrode Capacitance Sensors", AD7147 Data Sheet Rev. B, [online], Analog Devices, Inc., [retrieved on Dec. 7, 2009], <URL: http://www.analog.com/static/imported-files/data_sheets/AD7147.pdf>.

The ARRL Antenna Book, Published by the American Radio League, 1998, 15th Edition, ISBN: 1-87259-206-5.

Pascolini et al., U.S. Appl. No. 14/710,377, filed May 12, 2015.

Azad et al., U.S. Appl. No. 15/066,419, filed May 10, 2016.

* cited by examiner

ELECTRONIC DEVICE WITH INDIRECTLY FED SLOT ANTENNAS

BACKGROUND

This relates generally to electronic devices and, more particularly, to electronic devices with antennas.

Electronic devices often include antennas. For example, cellular telephones, computers, and other devices often contain antennas for supporting wireless communications.

It can be challenging to form electronic device antenna structures with desired attributes. In some wireless devices, the presence of conductive housing structures can influence antenna performance. Antenna performance may not be satisfactory if the housing structures are not configured properly and interfere with antenna operation. Device size can also affect performance. It can be difficult to achieve desired performance levels in a compact device, particularly when the compact device has conductive housing structures.

It would therefore be desirable to be able to provide improved wireless circuitry for electronic devices such as electronic devices that include conductive housing structures.

SUMMARY

An electronic device may be provided with antennas. The antennas may include a primary antenna and a secondary antenna that are coupled to radio-frequency transceiver circuitry by switching circuitry. The switching circuitry may be adjusted to switch a desired one of the antennas into use. Additional antennas such as a hybrid antenna may also be incorporated into the electronic device.

The antennas for the electronic device may be formed from slot antenna structures. A slot antenna structure may be formed from portions of a metal housing for an electronic device. For example, slots may be formed within the rear metal wall of a housing and a metal sidewall in the housing.

The slots of the slot antenna structures may be indirectly fed to form first and second indirectly fed slot antennas. The first and second indirectly fed slot antennas may be formed from slots in a rear surface of an electronic device and a sidewall of the electronic device. The slots may have open ends along an edge of the sidewall.

A hybrid antenna may also be formed in the electronic device. The hybrid antenna may have a slot antenna portion and may have a planar inverted-F antenna portion each of which contributes to the overall frequency response of the hybrid antenna. The slot antenna portion of the hybrid antenna may be formed from a slot in a metal housing or other conductive structures. For example, the slot antenna portion of the hybrid antenna may be formed from a slot that extends through a rear metal housing wall and a metal sidewall having an edge. The slot may have an opening along the edge of the metal sidewall.

DETAILED DESCRIPTION

Electronic devices may be provided with antennas. The antennas may include slot antennas formed in device structures such as electronic device housing structures. Illustrative electronic devices that have housings that accommodate slot antennas are shown in FIGS. 1, 2, 3, and 4.

Figure 1:
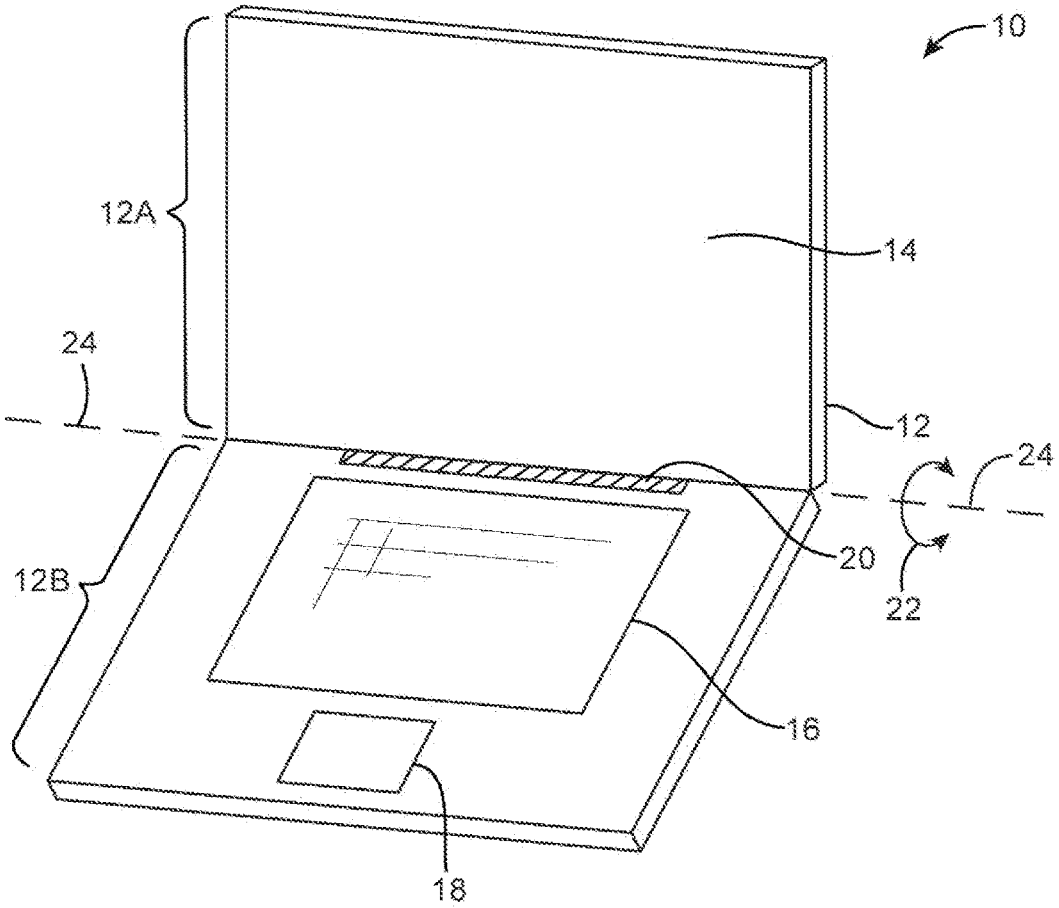
FIG. 1 is a perspective view of an illustrative electronic device such as a laptop computer in accordance with an embodiment.

Electronic device 10 of FIG. 1 has the shape of a laptop computer and has upper housing 12A and lower housing 12B with components such as keyboard 16 and touchpad 18. Device 10 has hinge structures 20 (sometimes referred to as a clutch barrel) to allow upper housing 12A to rotate in directions 22 about rotational axis 24 relative to lower housing 12B. Display 14 is mounted in housing 12A. Upper housing 12A, which may sometimes be referred to as a display housing or lid, is placed in a closed position by rotating upper housing 12A towards lower housing 12B about rotational axis 24.

Figure 2:
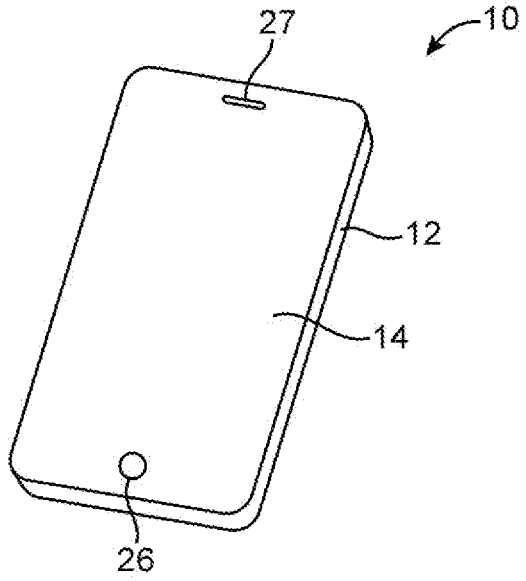
FIG. 2 is a perspective view of an illustrative electronic device such as a handheld electronic device in accordance with an embodiment.

FIG. 2 shows an illustrative configuration for electronic device 10 based on a handheld device such as a cellular telephone, music player, gaming device, navigation unit, or other compact device. In this type of configuration for device 10, device 10 has opposing front and rear surfaces. The rear surface of device 10 may be formed from a planar portion of housing 12. Display 14 forms the front surface of device 10. Display 14 may have an outermost layer that includes openings for components such as button 26 and speaker port 27.

Figure 3:
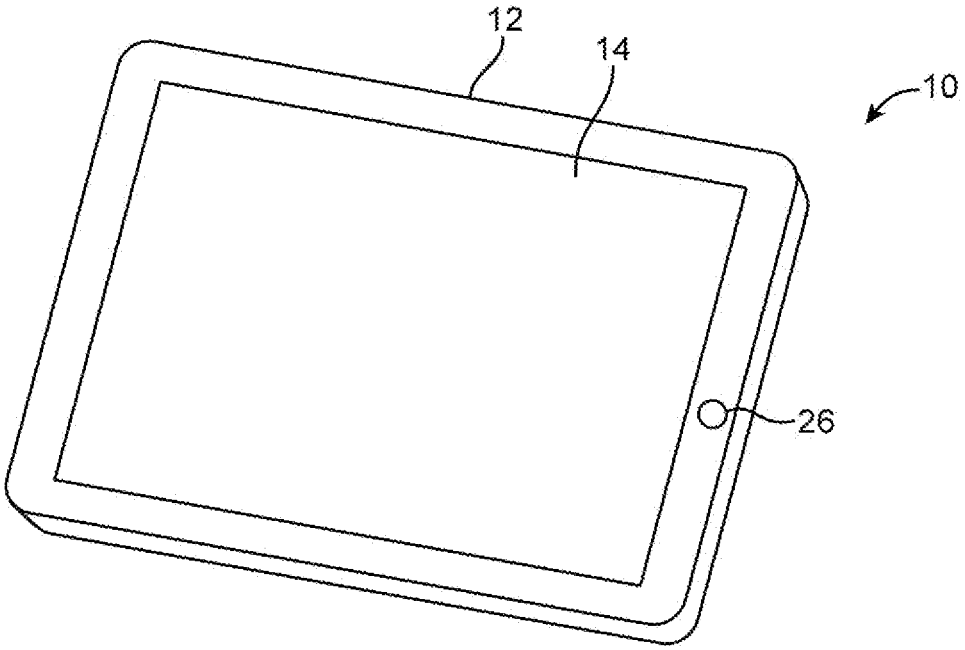
FIG. 3 is a perspective view of an illustrative electronic device such as a tablet computer in accordance with an embodiment.

In the example of FIG. 3, electronic device 10 is a tablet computer. In electronic device 10 of FIG. 3, device 10 has opposing planar front and rear surfaces. The rear surface of device 10 is formed from a planar rear wall portion of housing 12. Curved or planar sidewalls may run around the periphery of the planar rear wall and may extend vertically upwards. Display 14 is mounted on the front surface of device 10 in housing 12. As shown in FIG. 3, display 14 has an outermost layer with an opening to accommodate button 26.

Figure 4:
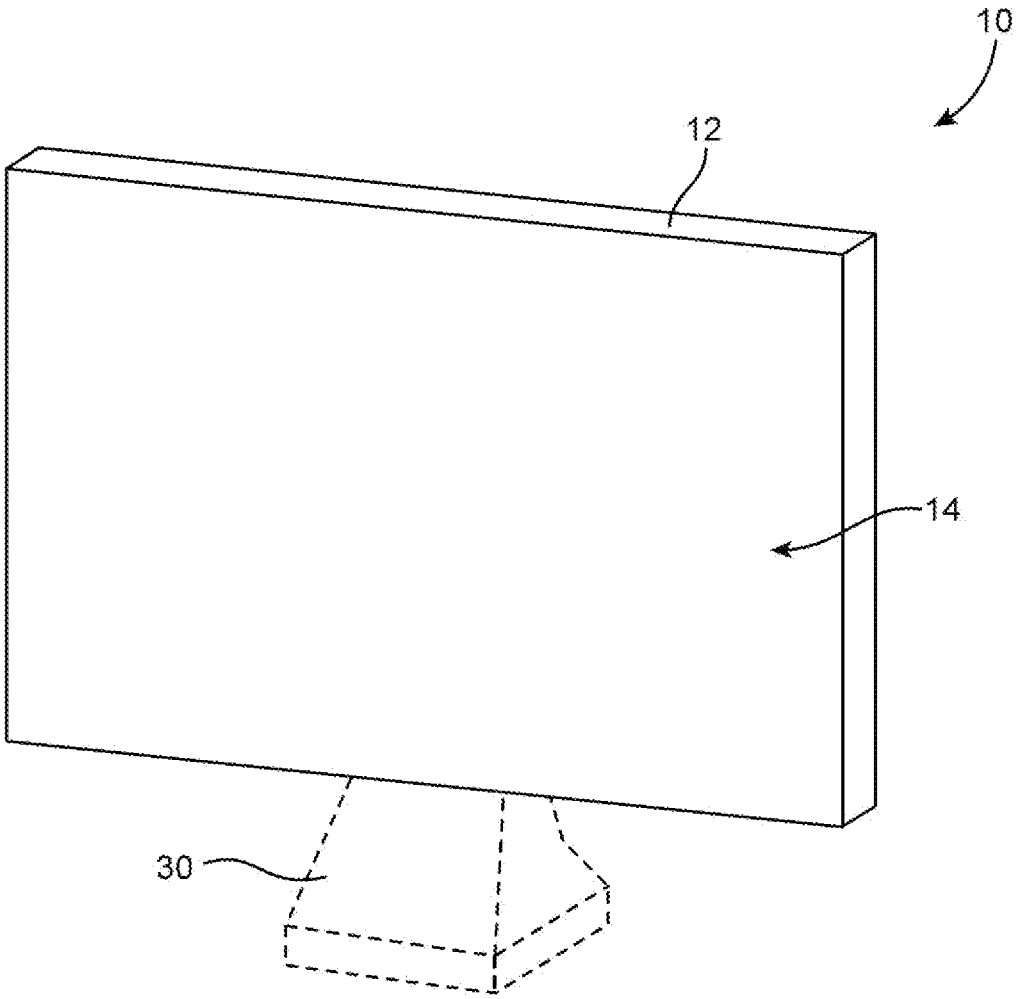
FIG. 4 is a perspective view of an illustrative electronic device such as a display for a computer or television in accordance with an embodiment.

FIG. 4 shows an illustrative configuration for electronic device 10 in which device 10 is a computer display, a computer that has an integrated computer display, or a television. Display 14 is mounted on a front face of device 10 in housing 12. With this type of arrangement, housing 12 for device 10 may be mounted on a wall or may have an optional structure such as support stand 30 to support device 10 on a flat surface such as a table top or desk.

An electronic device such as electronic device 10 of FIGS. 1, 2, 3, and 4, may, in general, be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. The examples of FIGS. 1, 2, 3, and 4 are merely illustrative.

Device 10 may include a display such as display 14. Display 14 may be mounted in housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 14 may be protected using a display cover layer such as a layer of transparent glass or clear plastic. Openings may be formed in the display cover layer. For example, an opening may be formed in the display cover layer to accommodate a button, an opening may be formed in the display cover layer to accommodate a speaker port, etc.

Housing 12 may be formed from conductive materials and/or insulating materials. In configurations in which housing 12 is formed from plastic or other dielectric materials, antenna signals can pass through housing 12. Antennas in this type of configuration can be mounted behind a portion of housing 12. In configurations in which housing 12 is formed from a conductive material (e.g., metal), it may be desirable to provide one or more radio-transparent antenna windows in openings in the housing. As an example, a metal housing may have openings that are filled with plastic antenna windows. Antennas may be mounted behind the antenna windows and may transmit and/or receive antenna signals through the antenna windows.

Figure 5:
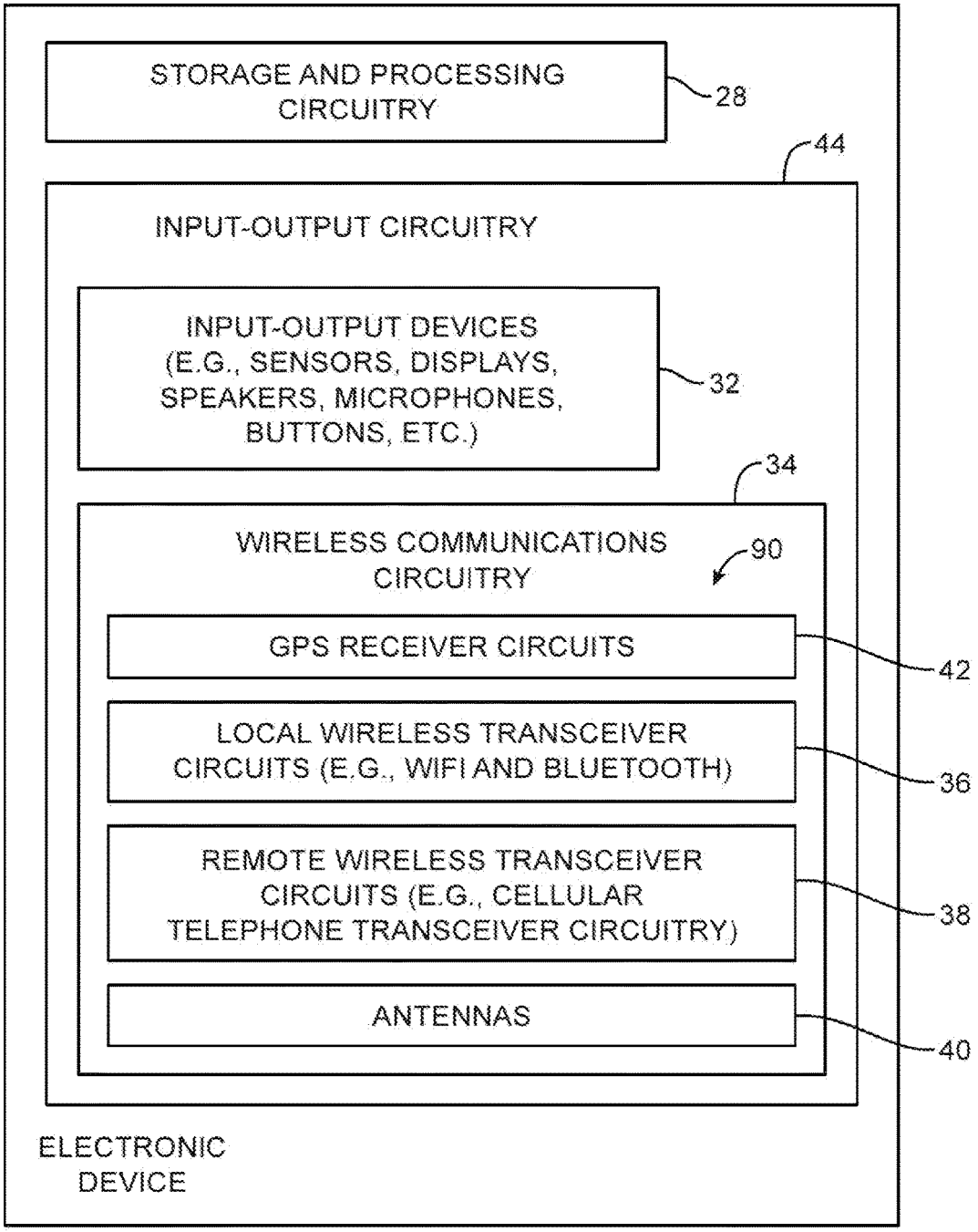
FIG. 5 is a schematic diagram of illustrative circuitry in an electronic device in accordance with an embodiment.

A schematic diagram showing illustrative components that may be used in device 10 is shown in FIG. 5. As shown in FIG. 5, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g. IEEE 802.11 protocols—sometimes referred to as WiFi®), protocols for other short-range wireless communications links such as the Bluetooth® protocol, cellular telephone protocols. MIMO protocols, antenna diversity protocols, etc.

Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, click wheels, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors, etc.

Input-output circuitry 44 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may be wireless local area network transceiver circuitry that may handle 2.4 GHz and 5 GHz bands for WiFi® (IEEE 802.11) communications and that may handle the 2.4 GHz Bluetooth® communications band.

Circuitry 34 may use cellular telephone transceiver circuitry 38 for handling wireless communications in frequency ranges such as a low communications band from 700 to 960 MHz, a midband from 1710 to 2170 MHz and a high band from 2300 to 2700 MHz or other communications bands between 700 MHz and 2700 MHz or other suitable frequencies (as examples). Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc. Wireless communications circuitry 34 may include satellite navigation system circuitry such as global positioning system (GPS) receiver circuitry 42 for receiving GPS signals at 1575 MHz or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 6:
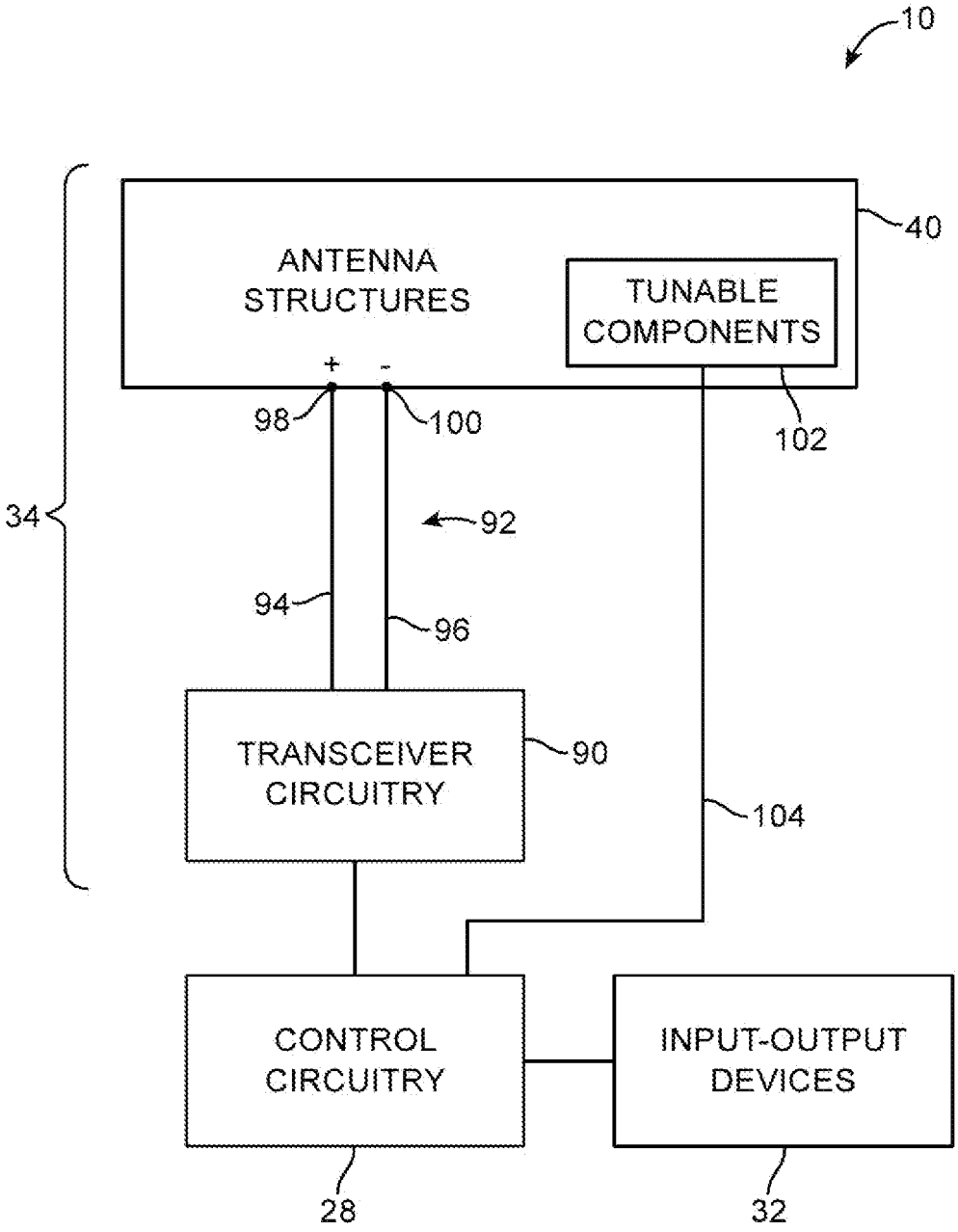
FIG. 6 is a schematic diagram of illustrative wireless circuitry in accordance with an embodiment.

As shown in FIG. 6, transceiver circuitry 90 in wireless circuitry 34 may be coupled to antenna structures 40 using paths such as path 92. Wireless circuitry 34 may be coupled to control circuitry 28. Control circuitry 28 may be coupled to input-output devices 32. Input-output devices 32 may supply output from device 10 and may receive input from sources that are external to device 10.

To provide antenna structures 40 with the ability to cover communications frequencies of interest, antenna structures 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna structures 40 may be provided with adjustable circuits such as tunable components 102 to tune antennas over communications bands of interest. Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures.

During operation of device 10, control circuitry 28 may issue control signals on one or more paths such as path 104 that adjust inductance values, capacitance values, or other parameters associated with tunable components 102, thereby tuning antenna structures 40 to cover desired communications bands.

Path 92 may include one or more transmission lines. As an example, signal path 92 of FIG. 6 may be a transmission line having a positive signal conductor such as line 94 and a ground signal conductor such as line 96. Lines 94 and 96 may form parts of a coaxial cable or a microstrip transmission line (as examples). A matching network formed from components such as inductors, resistors, and capacitors may be used in matching the impedance of antenna structures 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry in antenna structures 40.

Transmission line 92 may be directly coupled to an antenna resonating element and ground for antenna 40 or may be coupled to near-field-coupled antenna feed structures that are used in indirectly feeding a resonating element for antenna 40. As an example, antenna structures 40 may form an inverted-F antenna, a slot antenna, a hybrid inverted-F slot antenna or other antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 100. As another example, antenna structures 40 may include an antenna resonating element such as a slot antenna resonating element or other element that is indirectly fed using near-field coupling. In a near-field coupling arrangement, transmission line 92 is coupled to a near-field-coupled antenna feed structure that is used to indirectly feed antenna structures such as an antenna slot or other element through near-field electromagnetic coupling.

Figure 7:
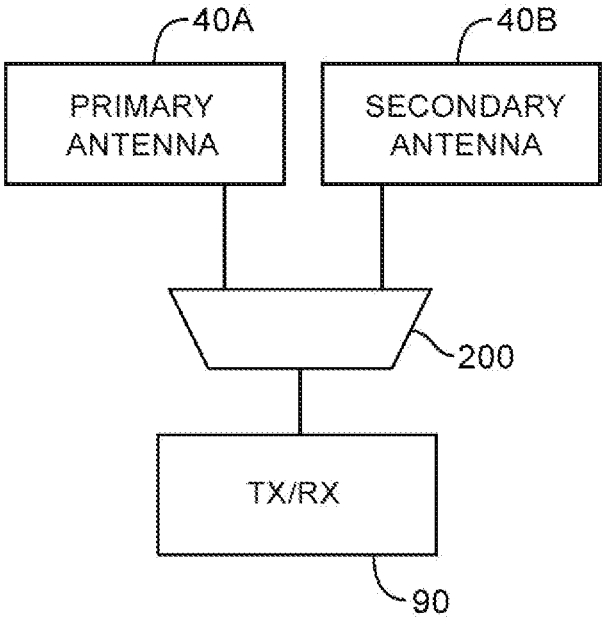
FIG. 7 is a schematic diagram of illustrative wireless circuitry in which multiple antennas have been coupled to transceiver circuitry using switching circuitry in accordance with an embodiment.

As shown in FIG. 7, antenna structures 40 may include multiple antennas such as secondary antenna 40A and primary antenna 40B. Primary antenna 40B may be used for transmitting and receiving wireless signals. Secondary antenna 40A may be switched into use when antenna 40B is blocked or otherwise degraded in performance (e.g., to receive and, if desired, to transmit wireless signals). Switching circuitry 200 may be used to select which of antennas 40A and 40B is coupled to transceiver circuitry 90. If desired, primary antenna 40B and/or secondary antenna 40A may cover multiple frequency bands of interest (e.g., a low band cellular band, a midband cellular band including GPS coverage, and a high band cellular band that may cover 2.4 GHz communications, if desired). Other communications band may be covered using antennas 40A and 40B, if desired.

Figure 8:
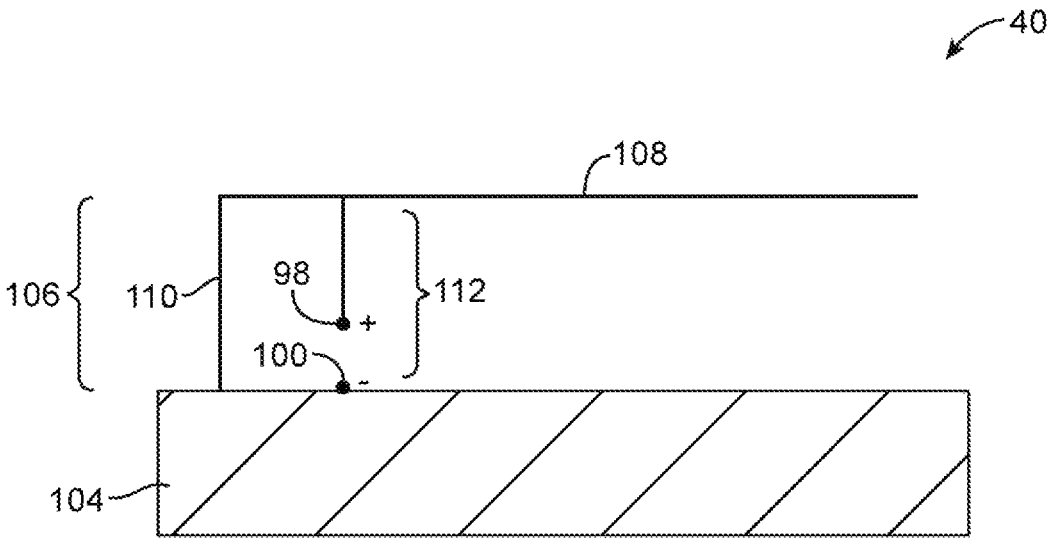
FIG. 8 is a diagram of an illustrative inverted-F antenna in accordance with an embodiment.

FIG. 8 is a diagram of illustrative inverted-F antenna structures that may be used in forming an antenna in device 10. Inverted-F antenna 40 of FIG. 8 has antenna resonating element 106 and antenna ground (ground plane) 104. Antenna resonating element 106 may have a main resonating element arm such as arm 108. The length of arm 108 may be selected so that antenna 40 resonates at desired operating frequencies. For example, if the length of arm 108 may be a quarter of a wavelength at a desired operating frequency for antenna 40. Antenna 40 may also exhibit resonances at harmonic frequencies.

Main resonating element arm 108 may be coupled to ground 104 by return path 110. Antenna feed 112 may include positive antenna feed terminal 98 and ground antenna feed terminal 100 and may run in parallel to return path 110 between arm 108 and ground 104. If desired, inverted-F antennas such as illustrative antenna 40 of FIG. 4 may have more than one resonating arm branch (e.g., to create multiple frequency resonances to support operations in multiple communications bands) or may have other antenna structures (e.g., parasitic antenna resonating elements, tunable components to support antenna tuning, etc.). A planar inverted-F antenna (PIFA) may be formed by implementing arm 108 using planar structures (e.g., a planar metal structure such as a metal patch or strip of metal that extends into the page of FIG. 8).

Figure 9:
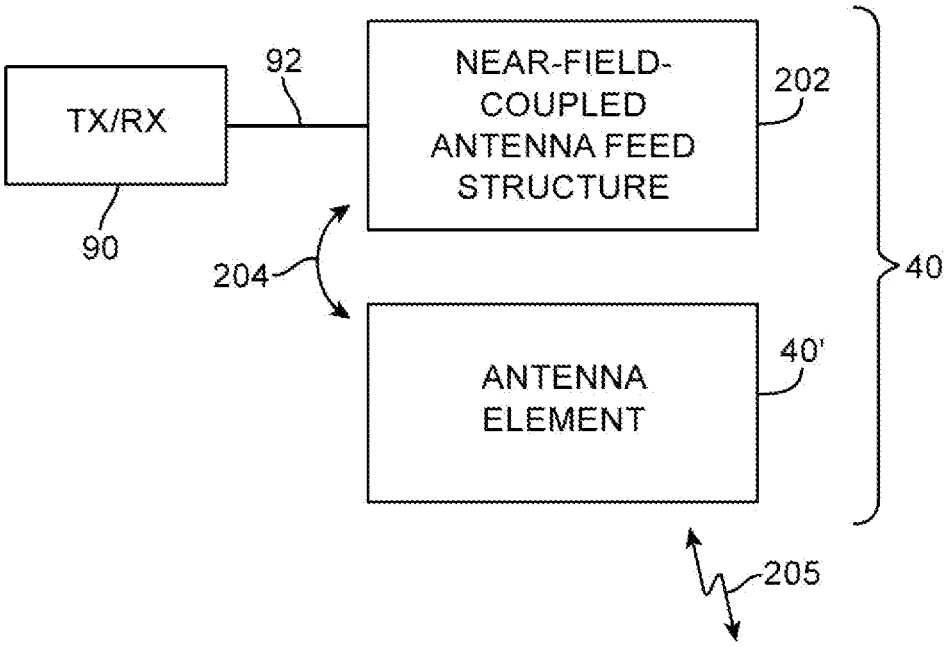
FIG. 9 is a diagram of an illustrative antenna that is fed using near-field coupling in accordance with an embodiment.

FIG. 9 shows how antenna 40 may be indirectly fed using a near-field coupling arrangement. With this type of arrangement, transceiver 90 is connected to near-field-coupled antenna feed structure 202 by transmission line 92. Antenna 40 may include a resonating element such as a slot or other antenna resonating element structure (antenna element 40'). Structure 202 may include a strip of metal, a patch of metal, planar metal members with other shapes, a loop of metal, or other structure that is near-field coupled to antenna resonating element 40' by near-field coupled electromagnetic signals 204. Structure 202 does not produce significant far-field radiation during operation (i.e., structure 202 does not itself form a far-field antenna but rather serves as a coupled feed for a slot antenna structure or other antenna resonating element structure for antenna 40). During operation, the indirect feeding of element 40' by structure 202 allows antenna element 40' and therefore antenna 40 to receive and/or transmit far-field wireless signals 205 (i.e., radio-frequency antenna signals for antenna 40).

Figure 10:
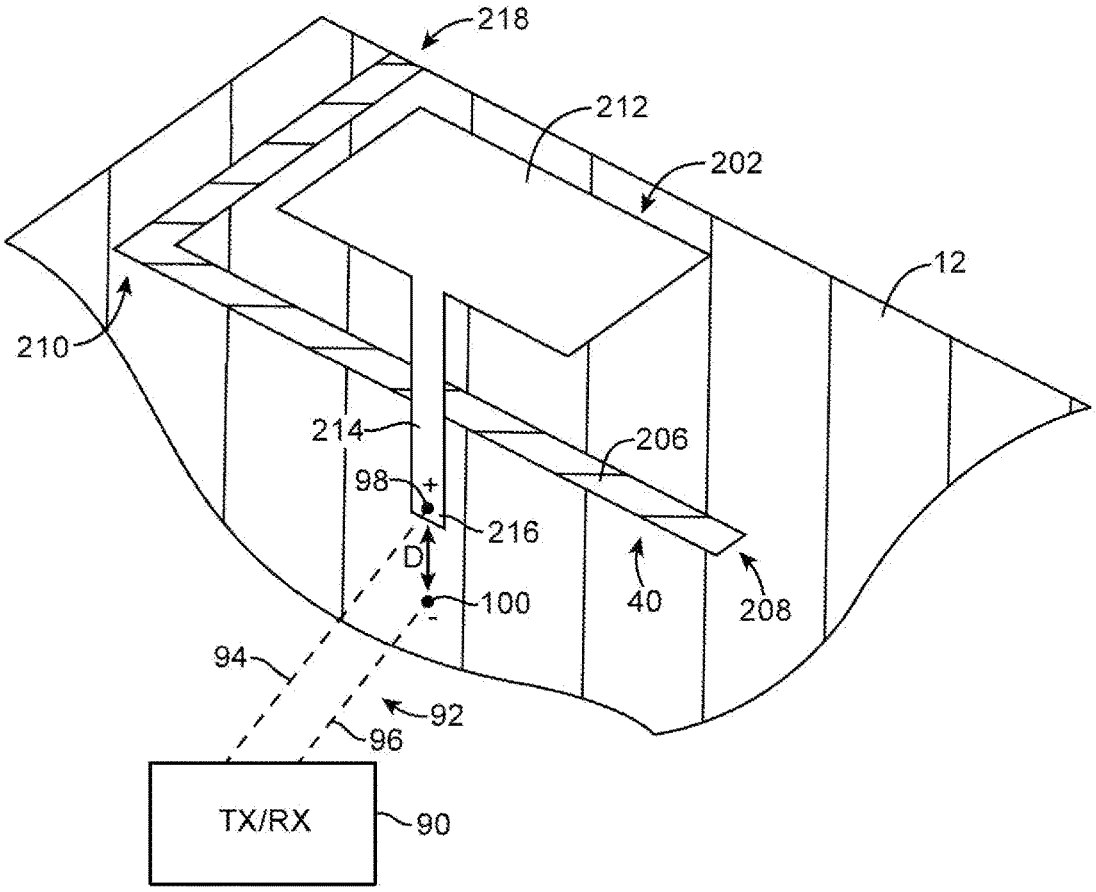
FIG. 10 is a perspective view of a slot antenna being fed using near-field coupling in accordance with an embodiment.

A perspective view of an illustrative indirectly feed (coupled feed) configuration in which a slot-based antenna is being indirectly fed is shown in FIG. 10. With the arrangement of FIG. 10, antenna 40 is a slot-based antenna formed from slot 206 in a ground plane structure such as metal housing 12 of device 10. Slot 206 may be filled with plastic or other dielectric. In the example of FIG. 10, slot 206 has an open end such as end 218 and an opposing closed end such as closed end 208. A slot antenna such as slot antenna 40 of FIG. 10 that has an open end and a closed end may sometimes be referred to as an open slot antenna. If desired, slot antenna 40 may be a closed slot antenna (i.e., end 218 may be closed by providing a short circuit path across the slot opening at end 218 so that both ends of the slot are closed). Slot antenna 40 of FIG. 10 is based on a slot that has bend 210. If desired, slots for slot antennas such as slot 206 may be provided with two bends, three or more bends, etc. The example of FIG. 10 is merely illustrative.

Slot antenna 40 may be near-field coupled to near-field-coupled antenna feed structure 202. Structure 202 may be formed from a patch of metal such as patch 212 with a bent leg such as leg 214. Leg 214 extends downwards towards ground plane 12. Tip 216 of leg 214 is separated from ground plane 12 by air gap D (i.e., tip 216 is not directly connected to ground 12).

Transceiver circuitry 90 is coupled to antenna feed terminals such as terminals 98 and 100 by transmission line 92. Terminal 98 may be connected to tip portion 216 of leg 214 of near-field-coupled antenna feed structure 202. Terminal 100 may be connected to ground structure 12. Positive signal line 94 may be coupled to terminal 98. Ground signal line 96 may be coupled to terminal 100.

Near-field-coupled antenna feed structure 202 is near-field coupled to slot antenna 40 by near-field electromagnetic signals and forms an indirect antenna feed for antenna 40. During operation, transceiver circuitry 90 can transmit and receive wireless radio-frequency antenna signals with antenna 40 (i.e., with slot 206) using coupled feed structure 202.

Figure 11:
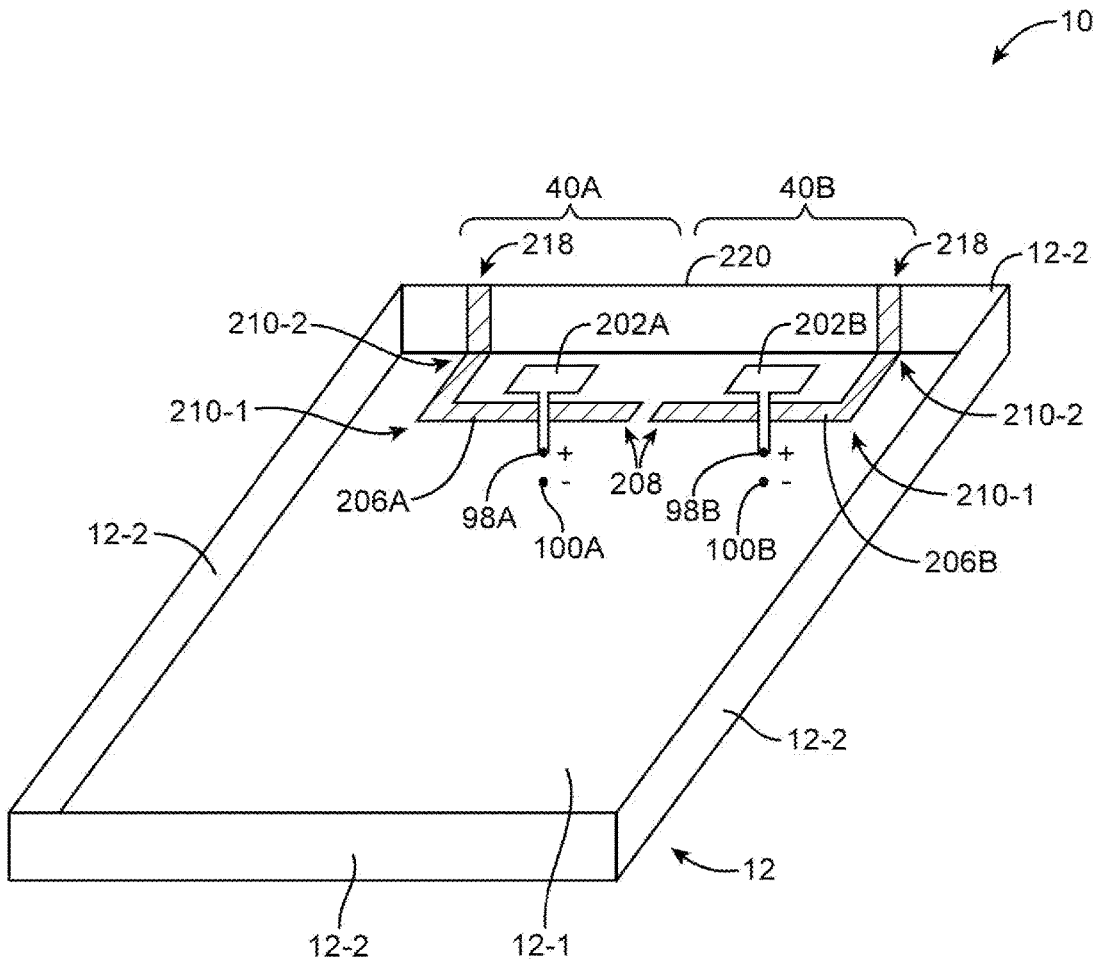
FIG. 11 is a perspective view of an interior portion of an electronic device housing having a pair of slots and associated near-field coupling structures in accordance with an embodiment.

FIG. 11 is a perspective interior view of an illustrative configuration that may be used for housing 12. Housing 12 of FIG. 11 has a rear wall such as planar rear wall 12-1 and has flat or curved sidewalls 12-2 that run around the periphery of rear wall 12-1 and that extend vertically upwards to support display 14 (not shown in FIG. 11).

Slots 206A and 206B are formed in housing walls 12-1 and 12-2. Plastic or other dielectric may be used to fill slots 206A and 206B. Slots 206A and 206B may be open ended slots having closed ends 208 and open ends 218 or one or both of slots 206A and 206B may be closed slots. Slots 206A and 206B may have bends such as bends 210-1 and 210-2 that allow slots 206A and 206B to extend across portions of rear wall 12-1 and up side walls 12-2. Openings 218 may be formed along upper edge 220 of housing sidewall 12. Near-field-coupled antenna feed structure 202A is electromagnetically coupled to slot 206A and allows slot antenna 40A to be indirectly feed by transceiver circuitry 90 using terminals 98A and 100A. Near-field-coupled antenna feed structure 202B is electromagnetically coupled to slot 206B and allows slot antenna 40B to be indirectly feed by transceiver circuitry 90 using terminals 98B and 100B. Switching circuitry such as switching circuitry 200 of FIG. 7 may be used to couple transceiver circuitry 90 to antennas 40A and 40B. Antenna 40A may be a secondary antenna and antenna 40B may be a primary antenna (or vice versa). Additional indirectly fed slot antennas 40 may be incorporated into housing 12, if desired. The two-antenna configuration of FIG. 11 is merely illustrative.

Figure 12:
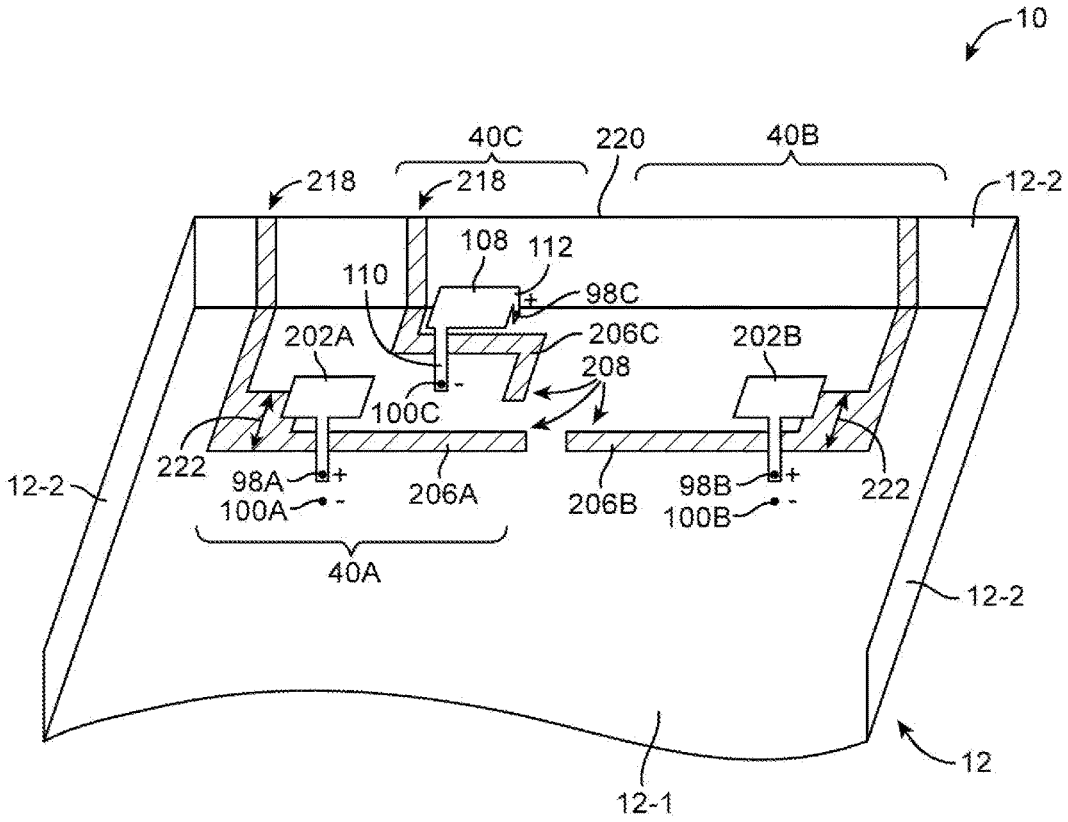
FIG. 12 is a perspective view of an illustrative interior portion of an electronic device having electronic device housing slots with multiple widths that are fed using near-field coupling structures and having a hybrid antenna that includes a planar inverted-F antenna structure and a slot antenna structure in accordance with an embodiment.

FIG. 12 is a perspective interior view of another illustrative configuration that may be used for providing slot antennas in housing 12. Housing 12 of FIG. 12 has a rear wall such as planar rear wall 12-1 and has flat or curved sidewalls 12-2 that extend upwards from the rear wall around the periphery of device 10. Slots 206A, 206B, and 206C may be formed in housing walls 12-1 and 12-2. Plastic or other dielectric may be used to fill slots 206A, 206B, and 206C. Slots 206A, 206B, and 206C may be open ended slots having closed ends 208 and open ends 218 or one or more of slots 206A. 206B, and 206C may be closed slots that are surrounded on all sides by metal (e.g., metal housing 12).

Slots 206A, 206B, and 206C may have bends that allow slots 206A, 206B, and 206C to extend across portions of rear wall 12-1 and up a given one of sidewalls 12-2. Openings 218 may be formed along upper edge 220 of housing wall 12. Slots 206A and 206B may have locally widened portions such as portions 222 (i.e., portions along the lengths of slots 206A and 206B where the widths of the slots have been widened relative to the widths of the slots elsewhere along their lengths). The locally widened slot portion of each slot may exhibit a reduced capacitance that improves low band antenna efficiency.

Antennas 40A and 40B may be indirectly fed slot antennas. Near-field-coupled antenna feed structure 202A may be electromagnetically coupled to slot 206A and may allow slot antenna 40A to be indirectly feed by transceiver circuitry 90 using terminals 98A and 100A. Near-field-coupled antenna feed structure 202B may be electromagnetically coupled to slot 206B and may allow slot antenna 40B to be indirectly feed by transceiver circuitry 90 using terminals 98B and 100B. Switching circuitry such as switching circuitry 200 of FIG. 7 may be used to couple transceiver circuitry 90 to antennas 40A and 40B. Antenna 40A may be a secondary antenna and antenna 40B may be a primary antenna (or vice versa).

Antenna 40C may be a hybrid antenna that incorporates a slot antenna and a planar inverted-F antenna. The slot antenna portion of antenna 40C may be formed from slot 206C. The planar inverted-F portion of antenna 40C may be formed from a planar inverted-F antenna having main planar resonating element portion 108 (e.g., a rectangular metal patch or a planar metal structure with another suitable shape), a downward-extending leg forming feed path 112, and another downward-extending leg forming return path 110. Antenna 40C may be fed using positive antenna feed terminal 98C (i.e., a feed terminal on the tip of leg 112 that is separated from ground 12-1 by an air gap or other dielectric gap) and ground antenna feed terminal 100C (e.g., a terminal directly shorted to ground 12 on an opposing side of slot 206C from terminal 98C or shorted to ground 12 elsewhere on rear wall 12-1).

Antenna 40C may operate in one or more communications bands of interest. Both the slot antenna portion of antenna 40C formed from slot 206C and the planar inverted-F antenna portion of antenna 40C may contribute to the antenna performance of antenna 40C (i.e., both the slot antenna and planar inverted-F antenna may contribute to the antenna resonances of antenna 40C). This allows the hybrid antenna to effectively cover communications frequencies of interest. With one suitable arrangement, antenna 40C may operate in 2.4 GHz and 5 GHz communications bands (e.g., to support wireless local area network communications).

If desired, slot antennas in housing 12 may be provided with electrical components such as inductors, capacitors, resistors, and more complex circuitry formed from multiple circuit elements such as these. The components may be packed in surface mount technology (SMT) packages or other packages.

Figure 13:
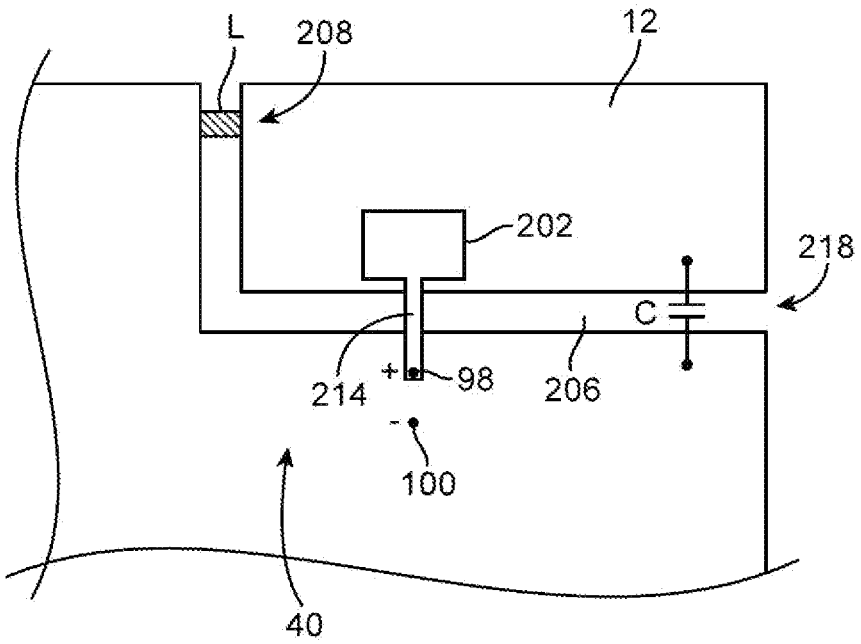
FIG. 13 is a diagram showing how electrical components may be incorporated into a slot antenna to adjust antenna performance in accordance with an embodiment.

The presence of additional electrical components in an antenna may be used to adjust antenna performance, so the antenna covers desired operating frequencies of interest. Consider, as an example, indirectly fed slot antenna 40 of FIG. 13. As shown in FIG. 13, antenna 40 may have a near-field-coupled antenna feed structure 202 that is used to provide an indirect feed arrangement for slot antenna 40. Transceiver circuitry 90 may be coupled to feed terminals 98 and 100, as described in connection with FIG. 10. Capacitor C and/or inductor L may be incorporated into antenna 40 using surface mount technology components or other electrical components. One or more capacitors such as capacitor C may, for example, bridge slot 206 at one or more locations along the length of slot 206. Capacitor C may be implemented using a discrete capacitor or other capacitor structures. Inductor L may be used to form closed end 208 of slot 206 and may be formed from a discrete inductor and/or a length of metal with an associated inductance. The inclusion of capacitor C into antenna 40 may help reduce the size of antenna 40 (e.g., the length of slot 206) while ensuring that antenna 40 can continue to operate in desired communications bands. The inclusion of inductor L into antenna 40 may somewhat reduce low band antenna efficiency, but will also help reduce the size of antenna 40 (e.g., by minimizing slot length). Elements such as inductor L and capacitor C may, if desired, be tunable elements so that antenna 40 can be tuned to cover frequencies of interest, as described in connection with tunable components 102 of FIG. 6. The use of coupled (indirect) feeding arrangements for the slot antennas in device 10 may help increase antenna bandwidth while minimizing slot length requirements (e.g., by shifting maximum antenna currents towards the edge of housing 12 or via other mechanisms). Other types of feeding arrangements may be used, if desired.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a metal housing that forms a ground plane, wherein a slot is formed in the ground plane, the slot has a bend, the metal housing has a planar rear wall and a sidewall that extends from the rear wall, the slot is formed in the rear wall and the sidewall, the slot extends from a first edge of the sidewall to an opposing second edge of the sidewall, and the slot has an opening along the second edge of the sidewall;

an indirectly fed slot antenna formed from the slot, the indirectly fed slot antenna comprising a near-field-coupled antenna feed structure that is formed from a planar metal structure that is near-field coupled to the slot;

a first tunable component coupled across the slot at a first side of the near-field-coupled antenna feed structure; and a second tunable component coupled across the slot at a second side of the near-field coupled antenna feed structure.

2. The electronic device defined in claim 1 wherein the planar metal structure comprises a patch of metal that overlaps the slot.

3. The electronic device defined in claim 1 further comprising a display mounted in the metal housing.

4. An electronic device, comprising:

a metal housing having at least first and second slots, wherein portions of the metal housing run along opposing sides of the first slot and portions of the metal housing run along opposing sides of the second slot, the first slot has a first segment, a second segment that extends substantially perpendicular to the first segment, and a third segment coupled between the first and second segments, the first and second segments have a first width, and the third segment has a second width that is greater than the first width;

a first indirectly fed slot antenna formed from the first slot, wherein the first indirectly fed slot antenna comprises a first near-field coupled antenna feed structure having a first metal structure that overlaps the first slot and that is separated from the first slot; and a second indirectly fed slot antenna formed from the second slot, wherein the second indirectly fed slot antenna comprises a second near-field coupled antenna feed structure having a second metal structure that overlaps the second slot and that is separated from the second slot.

5. The electronic device defined in claim 4 wherein the metal housing has a metal rear wall and has metal sidewalls, the first segment of the first slot is formed in the metal rear wall and in a given one of the metal sidewalls, and the second slot has a portion in the metal rear wall and a portion in the given one of the metal sidewalls.

6. The electronic device defined in claim 5 further comprising a third antenna having a third slot in the metal housing.

7. The electronic device defined in claim 6 wherein the third slot is formed at least partly in the given one of the metal sidewalls.

8. The electronic device defined in claim 7 wherein the third antenna comprises a hybrid antenna having a slot antenna portion formed from the third slot and having a planar inverted-F antenna portion.

9. The electronic device defined in claim 8 wherein a portion of the third slot is formed in the metal rear wall and portions of the metal rear wall run along opposing sides of the third slot.

10. The electronic device defined in claim 9 wherein the given one of the metal sidewalls has an edge and the first and second slots are open slots having respective first and second slot openings that are located along the edge of the given one of the metal sidewalls.

11. The electronic device defined in claim 4 further comprising a third antenna having a third slot in the metal housing.

12. The electronic device defined in claim 11 wherein the third antenna comprises a hybrid antenna having a slot antenna portion formed from the third slot and having a planar inverted-F antenna portion.

13. An electronic device, comprising:

a metal housing having a rear wall, a sidewall that extends from the rear wall, and first and second slots, wherein the first slot has an open end formed at a first edge of the sidewall and an opposing closed end formed in the rear wall, the second slot has an open end formed at the first edge of the sidewall and an opposing closed end formed in the rear wall, the first and second slots each extend from a second edge of the sidewall to the first edge of the sidewall, portions of the rear wall are on opposing sides of the first slot and at the closed end of the first slot, portions of the rear wall are on opposing sides of the second slot and at the closed end of the second slot, and the metal housing forms a ground plane;

a first indirectly fed slot antenna formed from the first slot, wherein the first indirectly fed slot antenna is fed using a first antenna feed element; and a second indirectly fed slot antenna formed from the second slot, wherein the second indirectly fed slot antenna is fed using a second antenna feed element that is different from the first antenna feed element.

14. The electronic device defined in claim 13 wherein the closed ends of the first and second slots face each other and are separated by portions of the rear wall.

15. The electronic device defined in claim 13, wherein the first slot comprises a first segment and a second segment, the second segment extends substantially perpendicular to the first segment and towards the second slot, the second slot comprises a third segment and a fourth segment, and the fourth segment extends substantially perpendicular to the third segment and towards the first slot.

16. The electronic device defined in claim 15, wherein a portion of the rear wall separates the fourth segment from the second segment, and the first and third segments have the same length.

17. The electronic device defined in claim 16, further comprising:

a first tunable component coupled across the first slot at a first side of the first antenna feed element; and a second tunable component coupled across the first slot at a second side of the first antenna feed element.

18. The electronic device defined in claim 1, wherein the first tunable component comprises a tunable inductor and the second tunable component comprises a tunable capacitor.

* * * * *